US005490817A

United States Patent [19]

Stander et al.

[11] Patent Number: 5,490,817

[45] Date of Patent: Feb. 13, 1996

[54] WRIST ARM EXERCISER

[76] Inventors: Maxwell Stander, 11512 Taber St., Silver Spring, Md. 20902; Radhakrishnan Chander, 1515 Jeff Davis Hwy.

[21] Appl. No.: 366,920

[22] Filed: Dec. 30, 1994

[51] Int. Cl.[6] ..... A63B 23/14

[52] U.S. Cl. ..... 482/46; 482/45; 482/49; 482/127

[58] Field of Search ..... 422/44, 45, 46, 422/127, 128, 49

[56] References Cited

U.S. PATENT DOCUMENTS

| | | | |
|---|---|---|---|
| 3,756,597 | 9/1973 | Monti | 482/128 |
| 3,764,131 | 10/1973 | Rooks | 482/46 |
| 5,222,926 | 6/1993 | Eggen | 482/49 |

*Primary Examiner*—Lynne A. Reichard

[57] ABSTRACT

A portable, compact exerciser comprising a semi-rigid torsion member with a pair of gripping surfaces at each end. The end faces of the gripping surfaces are designed to receive detachable handles orthogonally to the longitudinal axis of the torsion member. The torsion member comprising thin walled sections running along the longitudinal axis to offer resistance to any rotational force applied about the longitudinal axis of the torsion member. In one mode of operation, the user can primarily exercise the wrists by rotating the torsion member by rotating the gripping surfaces in a direction relative to each other. In another mode of operation, by moving the detachable handles attached to the gripping surfaces back and forth relative to each other in a plane orthogonal to the longitudinal axis of the torsion member, the user can exercise forearms and other muscle groups. The torsional resistance of the torsion member can be conveniently increased by using attachments that can be clipped on to the thin walled sections. Due to its simple construction, the exerciser can be easily manufactured at a low cost.

4 Claims, 2 Drawing Sheets

WRIST ARM EXERCISER

BACKGROUND OF THE INVENTION

This invention relates to a portable, hand-held exerciser capable of being manipulated to provide conditioning, particularly for the wrist, fingers and arms. In prior art, U.S. Pat. No. 5,167,596 provides the same function but relies on friction disks, spring loading, a double torque cone assembly and other mechanical features of complex construction that exhibit wear, and are expensive to manufacture and assemble.

SUMMARY OF THE INVENTION

In one embodiment, the invention comprises a portable hand-held exerciser of low-cost, durable and simple construction with left and right gripping surfaces connected by a torsion bar that provides resistance to a twisting force exerted by the wrists and fingers about its longitudinal axis. In the second embodiment, additional handles are inserted into the ends of the torsion bar, so that by moving the arms back and forth pivotally, the torsion bar may be twisted about its longitudinal axis. By holding one of the grips or handles firmly, the other hand is free to rotate the torsion bar in either direction and thereby exercise opposing muscles. Alternately, both hands can be simultaneously used to exert a torsional force on the torsion bar.

It is accordingly, an objective of the current invention to provide a portable hand-held exerciser to rehabilitate, and develop muscle strengths and endurance predominantly in the wrists, arms and fingers.

Another objective of this invention is to provide a hand-held portable exerciser which is simple in construction without complex friction disks and spring type mechanisms, that is easy to assemble and cheap to manufacture.

Yet another objective of this invention is to provide increasing degrees of torsional resistance by snapping clips on the thin-walled radially extending members of the torsion bar.

DESCRIPTION OF THE PREFERRED EMBODIMENTS

Figure 1:
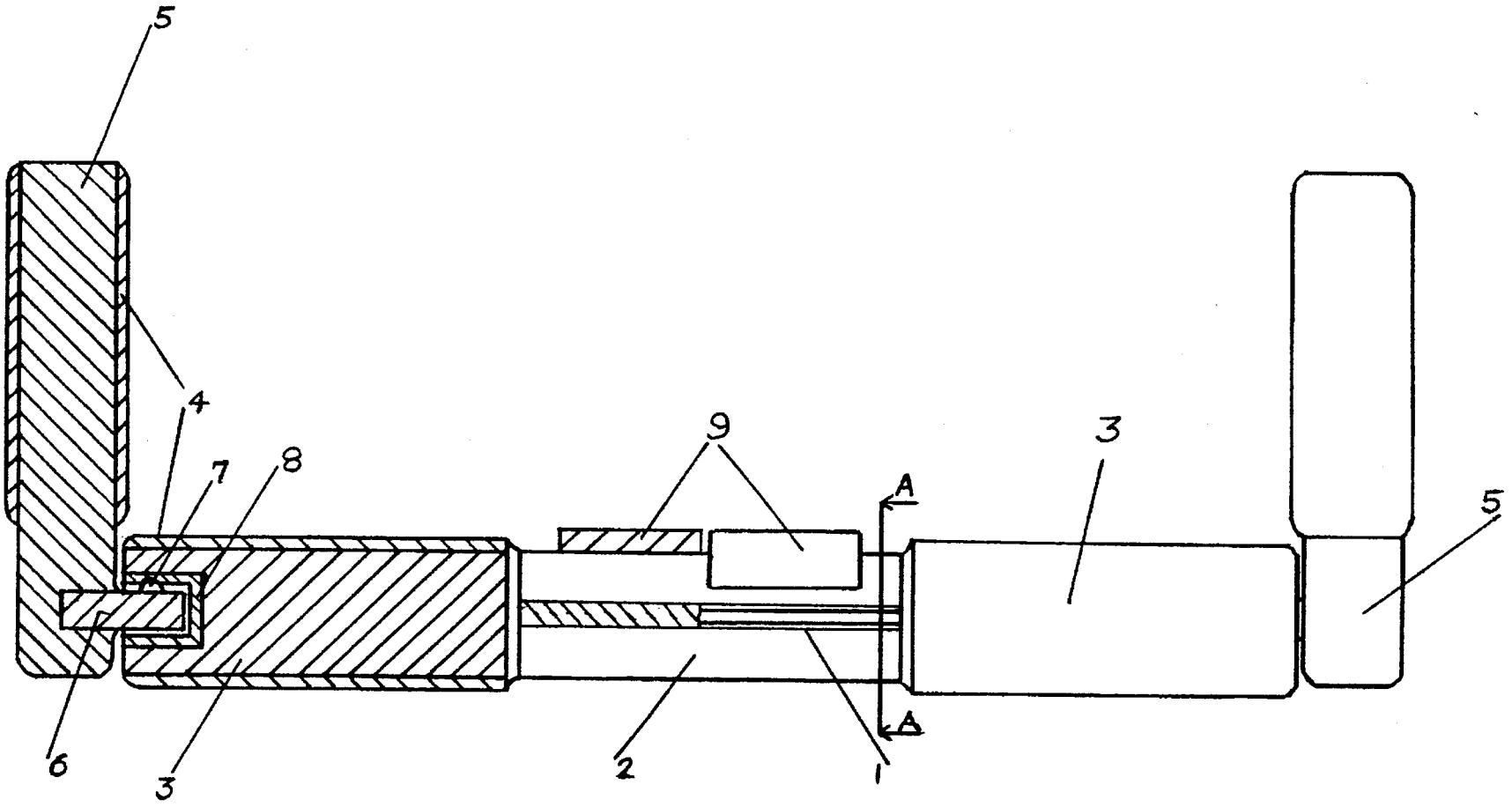
FIG. 1 is a front elevation of the exerciser, partly in section to reveal the internal construction and one of the detachable handles.

One embodiment of the exerciser as shown in FIG. 1, consists of a torsion bar 1 with elongated handles 3 for gripping attached at its extremities. The torsion bar 1 can be rotated either by holding one of the handles 3 and turning the other, or by moving both the handles 3 simultaneously in the opposite direction. The thin walled members 2 forming part of the torsion bar 1 and shown in FIG. 2, elastically offer resistance to such torsional motion. As envisioned in this invention, the torsion bar 1 along with the handles 3 at the extremities can be molded as an integral piece at a low manufacturing cost from a strong, semi-rigid material such as polyethylene or polypropylene.

Figure 3:
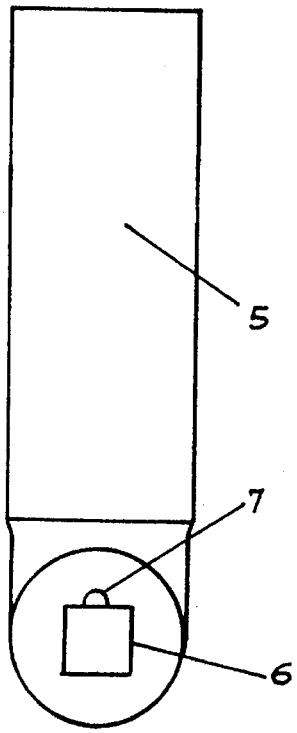
FIG. 3 is a side view of one of two similar looking detachable handles.
Figure 4:
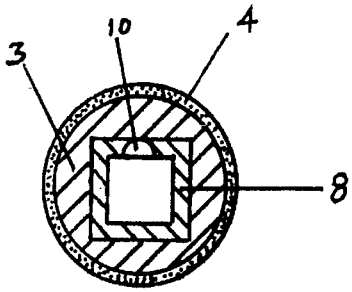
FIG. 4 is a side view of the one of the two similar looking gripping surfaces located at the extremities of the torsion bar.

In the other embodiment of the invention, detachable handles 5 shown in FIGS. 1 and 3 are inserted into sockets 8 shown in FIGS. 1 and 4 at the ends of the torsion bar 1, where they are retained by the spring-ball locking mechanisms 7 shown in FIGS. 1 and 3. The detachable handles 5 are located at right angles to the torsion bar 1, where they may be rotated relative to each other in a plane orthogonal to the longitudinal axis of the torsion bar 1. This embodiment is designed primarily for exercising the users' arm and shoulder muscles.

Figure 2:
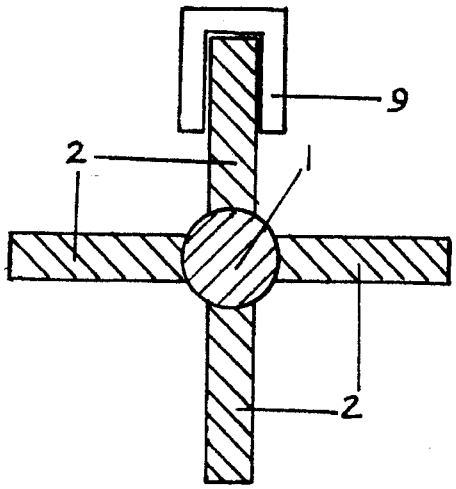
FIG. 2 is an enlarged sectional side view taken along the section A—A in FIG. 1.

In the above embodiments of the exerciser, as shown in FIGS. 1 and 4, both the sets of handles 3 and 5 have gripping materials 4 attached to their surfaces to facilitate holding. Also, the torsional resistance of the torsion bar 1 can be increased by snapping clips 9 on to the thin-walled members 2, as shown in FIGS. 1 and 2. The handles 5 and clips 9, can be conveniently inserted and removed without the need of any special tools.

We claim:

1. A portable hand-held exerciser comprising: an elongated bar, and a first pair of elongated handle means with gripping means located at the extremities of said elongated bar for rotation of said elongated bar about the longitudinal axis of said elongated bar; said elongated bar comprising a plurality of thin walled members extending radially from said elongated bar, attached to the periphery of said elongated bar to elastically offer resistance to rotation by one of said pair of elongated handle means of said elongated bar relative to the other about said longitudinal axis.

2. The exerciser defined in claim 1, in which the end faces of each of said pair of elongated handle means comprising socket means located in the end faces of said elongated bar for detachably engaging a second pair of elongated handle means which when attached orthogonally to said socket means, provide rotation of the said elongated bar about said longitudinal axis by rotating one of said second pair of elongated handle means relative to the other in a plane orthogonal to said longitudinal axis.

3. The exerciser described in claims 1 and 2, in which a pin is attached to one end of each of said second pair of elongated handle means; said pin comprising a spring-ball mechanism embedded in the periphery of the said pin; said socket means having an indentation on the inner surface to receive the spring-ball of said spring-ball mechanism located on said pin when the said second pair of elongated handle means are snapped into said socket means to engage said second pair of handle means.

4. The exerciser defined in claim 1, in which the resistance to rotation of said elongated bar about said longitudinal axis is increased by attaching detachable clip means to said thin-walled members to increase the thickness of said thin-walled members.

* * * * *